US010294932B2

(12) United States Patent
Chou

(10) Patent No.: US 10,294,932 B2
(45) Date of Patent: May 21, 2019

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 502 days.

(21) Appl. No.: 15/018,082

(22) Filed: Feb. 8, 2016

(65) Prior Publication Data

US 2016/0237996 A1 Aug. 18, 2016

(30) Foreign Application Priority Data

Feb. 13, 2015 (TW) ..... 104105168 A

(51) Int. Cl.

| | |
|---|---|
| ***F04B 39/12*** | (2006.01) |
| ***F04B 39/10*** | (2006.01) |
| ***F04B 39/00*** | (2006.01) |
| ***F04B 35/04*** | (2006.01) |
| ***F04B 39/14*** | (2006.01) |

(52) U.S. Cl.

CPC ..... *F04B 39/121* (2013.01); *F04B 35/04* (2013.01); *F04B 39/0005* (2013.01); *F04B 39/10* (2013.01); *F04B 39/125* (2013.01); *F04B 39/14* (2013.01)

(58) Field of Classification Search

CPC ..... F04B 35/04; F04B 39/0005; F04B 39/10; F04B 39/122; F04B 39/123; F04B 39/125; F04B 39/14; F04B 49/22

See application file for complete search history.

(56) References Cited

U.S. PATENT DOCUMENTS

2008/0145245 A1* 6/2008 Chou ..... B29C 73/166 417/415
2012/0121443 A1* 5/2012 Chou ..... F04B 35/04 417/297
2014/0112812 A1* 4/2014 Takemi ..... F04B 39/121 417/571

* cited by examiner

*Primary Examiner* — Dominick L Plakkoottam

(57) ABSTRACT

An improved air compressor includes a cylinder that is fitted with a piston body and defines at its top wall a plurality of exit holes having different diameters and communicating between the cylinder and an air storage container. The exit holes are sealed by plugs and compression springs. The exit holes allow the compressed air produced in the cylinder to enter the air storage container more quickly. When the piston body approaches the top wall of the cylinder, one exit hole, with a smaller diameter, allows the compressed air to enter the air storage container more easily. The exit holes with different diameters allow the piston body to move in the cylinder more smoothly, and thus the efficiency of inflating an object can be increased.

9 Claims, 12 Drawing Sheets

AIR COMPRESSOR

(a) TECHNICAL FIELD OF THE INVENTION

The present invention relates to an improved air compressor and, more particularly, to an air compressor which includes a cylinder defining a plurality of exit holes having different diameters, whereby the flow rate of compressed air entering the inner space of an air storage container can be significantly increased. Furthermore, since a plug corresponding to an exit hole having a smaller diameter will experience a smaller back force from the compressed air stored in the air storage container, so that, at a later stage of operation, the exit hole having a smaller diameter allows the compressed air to enter the air storage container more easily; therefore, the piston body can move in the cylinder more smoothly, and the efficiency of inflating an object can be increased.

(b) DESCRIPTION OF THE PRIOR ART

Currently, air compressors basically has a cylinder which allows a piston body to conduct reciprocating motion therein to produce compressed air which can overcome a valve mechanism, so that the compressed air can flow through an exit hole of the cylinder to enter the inner space of an air storage container or an air tank. The air storage container is provided with outlets for delivering the compressed air to an object to be inflated.

In conventional air compressors, there is only one exit hole defined at the cylinder for communicating with the air storage container. The exit hole of the cylinder is controlled by a valve mechanism, which generally includes a plug and a compression spring, so that the exit hole can be opened or closed properly according to the pressure of the compressed air. In operation, the compressed air produced in the cylinder can overcome the compressive force of the compression spring to enter the inner space of the air compressor. However, the compressed air stored in the air storage container can exert a back force on the plug, thus restraining the plug being moved away from the exit hole. As a result, the piston body, which conducts reciprocating motion in the cylinder, will be subjected to a greater resistance. Therefore, the piston body may not move smoothly in the cylinder, and thus the speed of inflating an object will become slow. Furthermore, the motor of the air compressor will probably overheat and thus the performance of the motor will decrease. Even worse, the motor may be under the risk of burning out.

In view of the foregoing, the applicant intends to develop an improved air compressor which can solve the shortcomings of conventional air compressors.

SUMMARY OF THE INVENTION

One object of the present invention is to provide an improved air compressor, wherein the cylinder of the air compressor defines a plurality of exit holes, through which the compressed air produced in the cylinder can enter the inner space of an air storage container, whereby the flow rate of the compressed air entering the air storage container can be significantly increased.

According to one feature of the present invention, the exit holes have different diameters, wherein, at a later stage of operation, one plug corresponding to an exit hole with a smallest diameter will be subjected to a smallest back force; namely, the plug can be pushed away from the corresponding exit hole more easily than the other plugs being pushed away from their corresponding exit holes. Thus, at a later stage operation, the resistance of the piston body conducting reciprocating motion can be reduced, so that the piston body can move in the cylinder more smoothly and the efficiency of inflating an object can be increased. Therefore, a lower-power motor can be used in the air compressor to quickly inflate an object.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
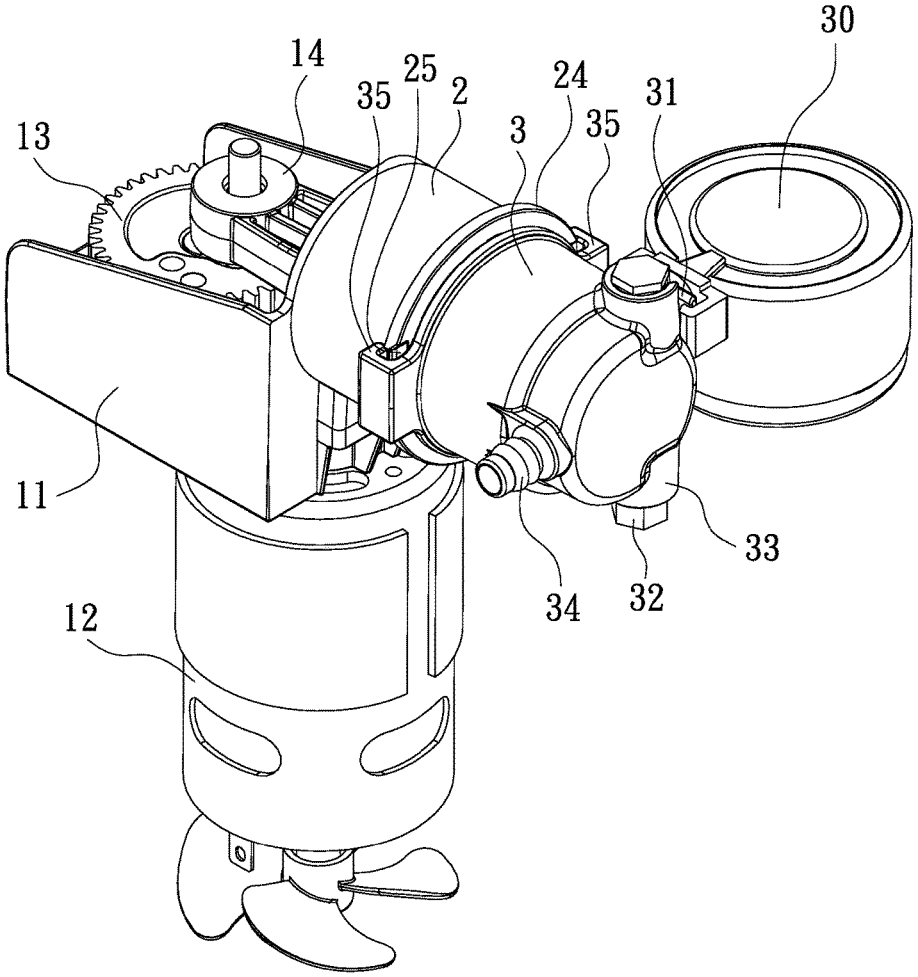
FIG. 1 shows a 3-dimensional view of an air compressor according to a first embodiment of the present invention.
Figure 2:
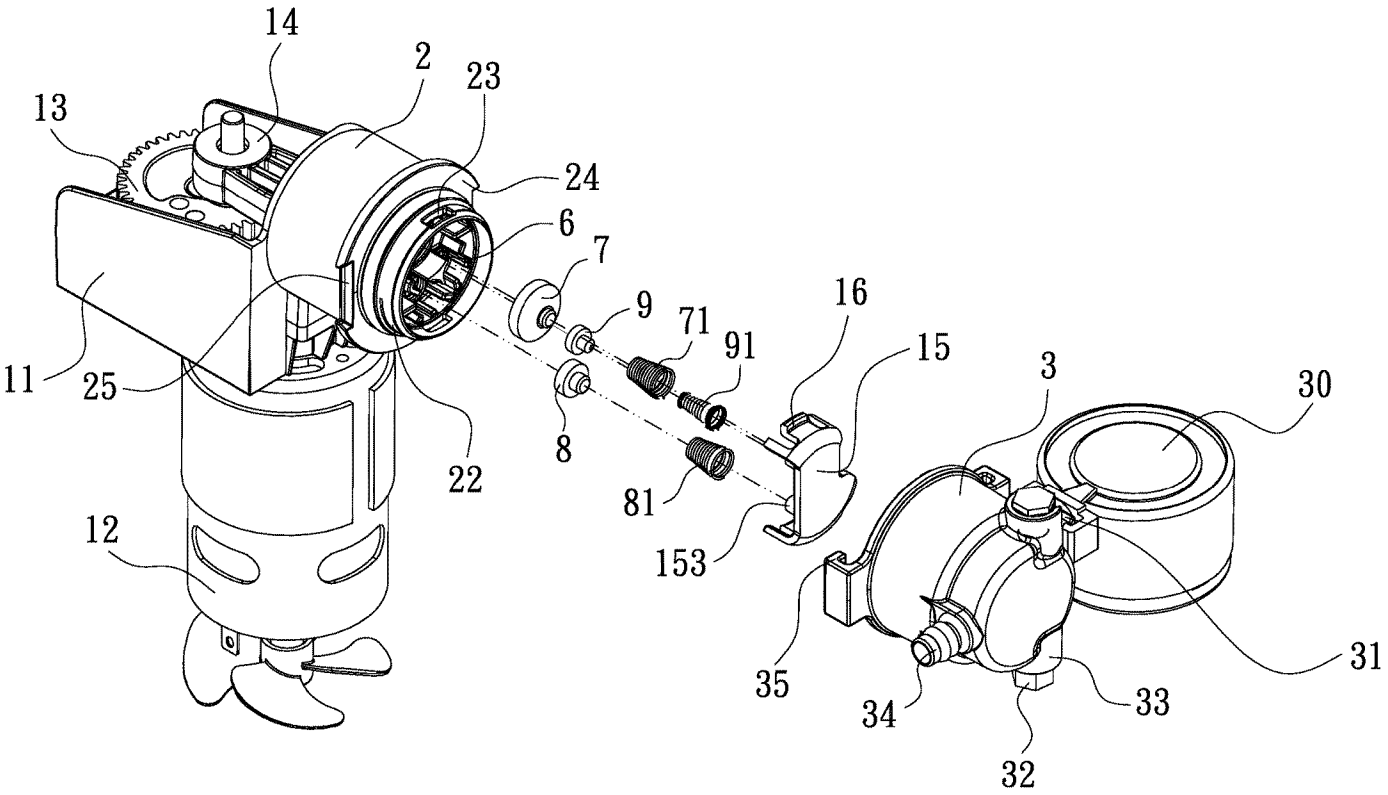
FIG. 2 shows an exploded view of the air compressor of the first embodiment
Figure 3:
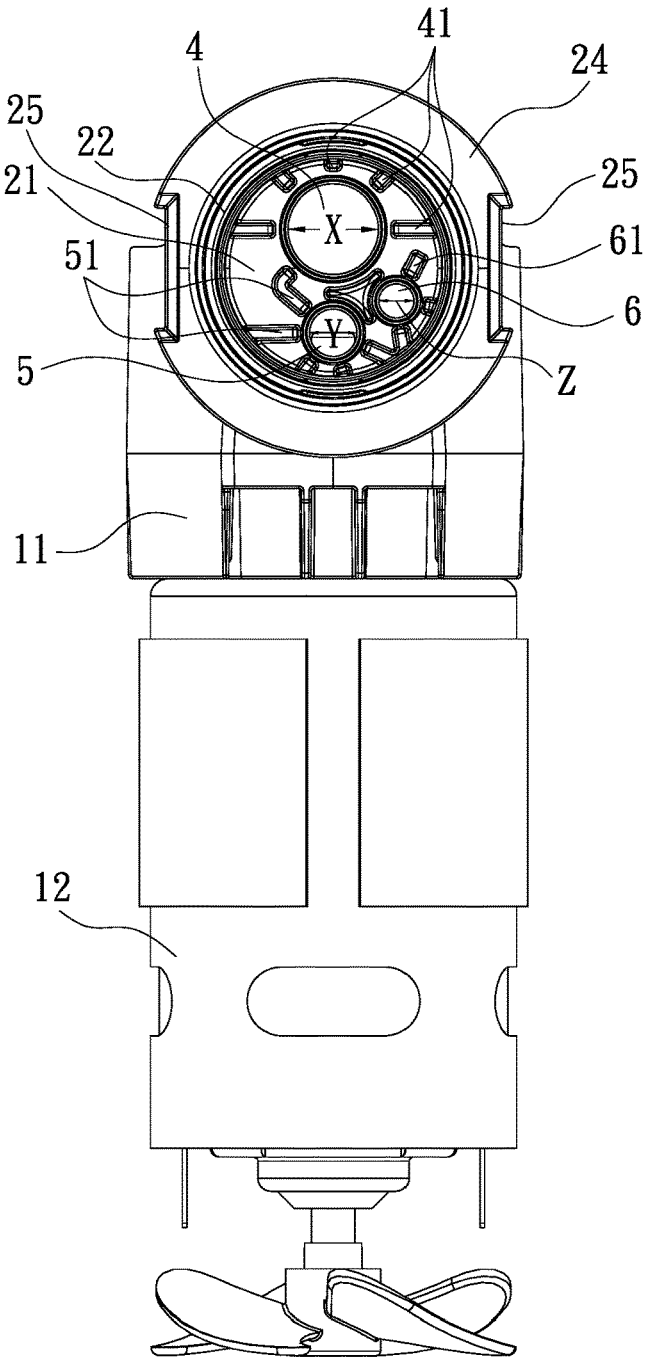
FIG. 3 shows a plan view of the air compressor of the first embodiment, wherein a cylinder used in the air compressor defines three exit holes.
Figure 4:
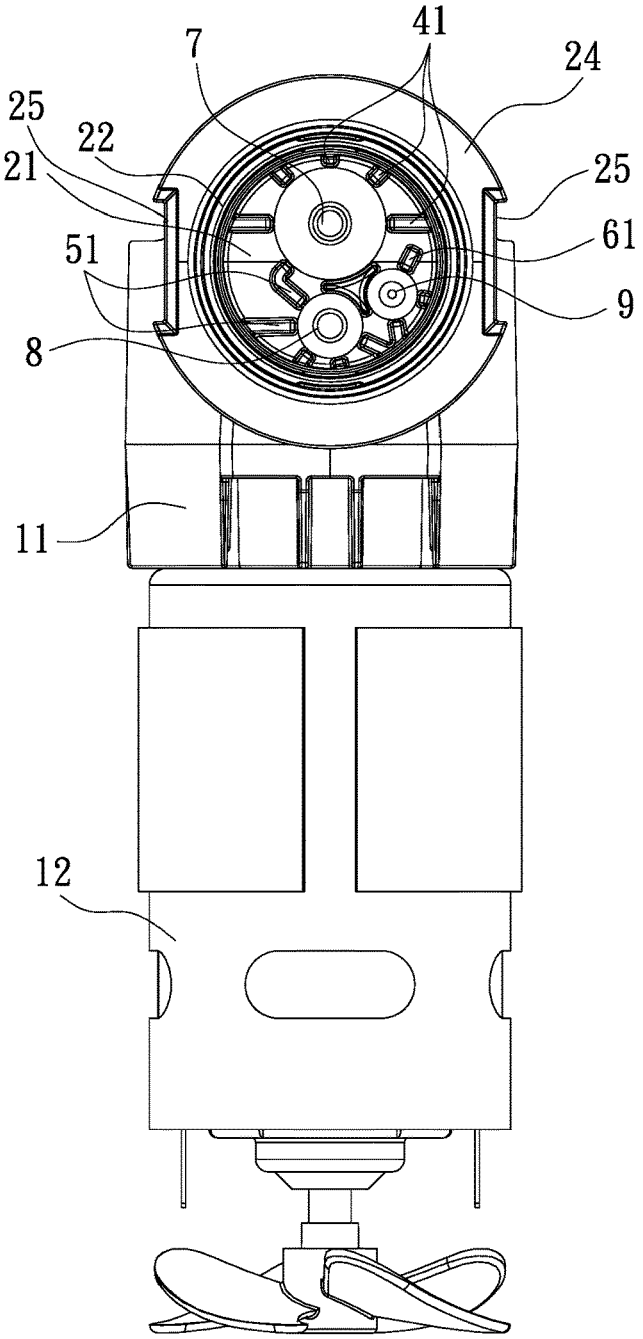
FIG. 4 shows a plan view of the air compressor of the first embodiment, wherein three plugs are respectively placed on the exit holes of the cylinder.
Figure 5:
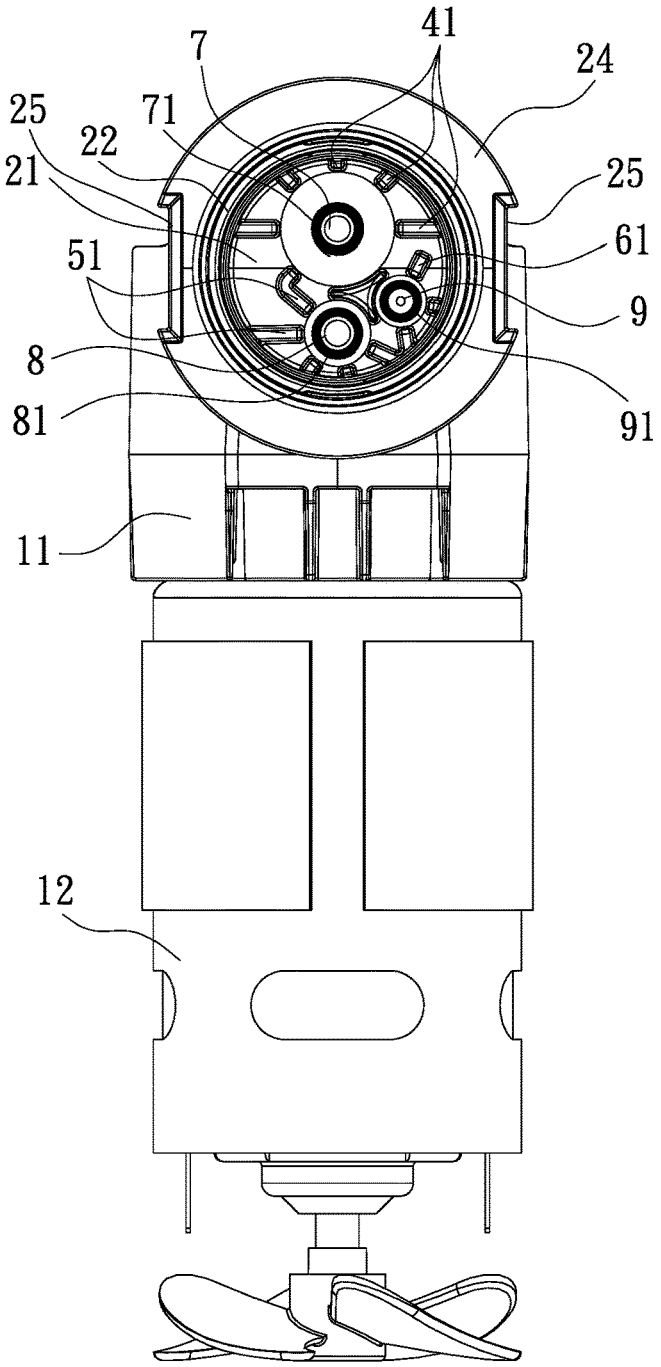
FIG. 5 shows a plan view of the air compressor of the first embodiment, wherein three compression springs are used to respectively urge the three plugs for sealing the exit holes.
Figure 6:
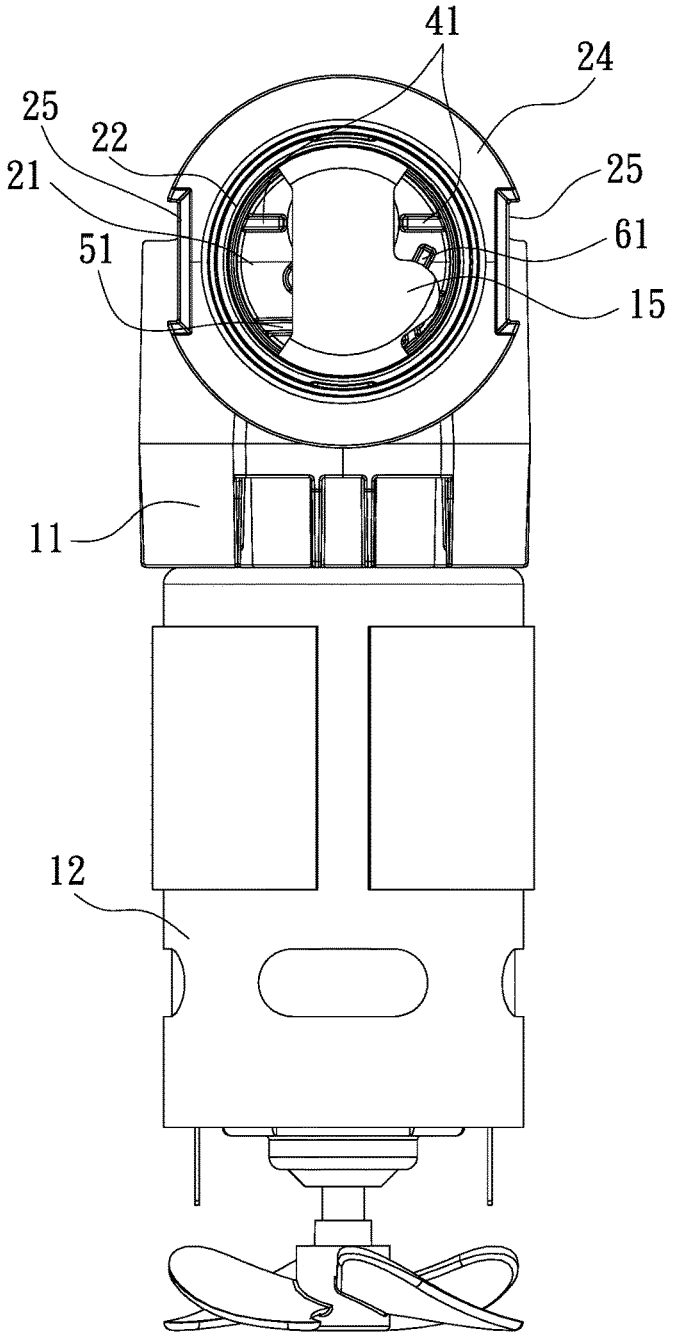
FIG. 6 shows a plan view of the air compressor of the first embodiment, wherein a positioning cap is used to retain the plugs and the compression springs.
Figure 7:
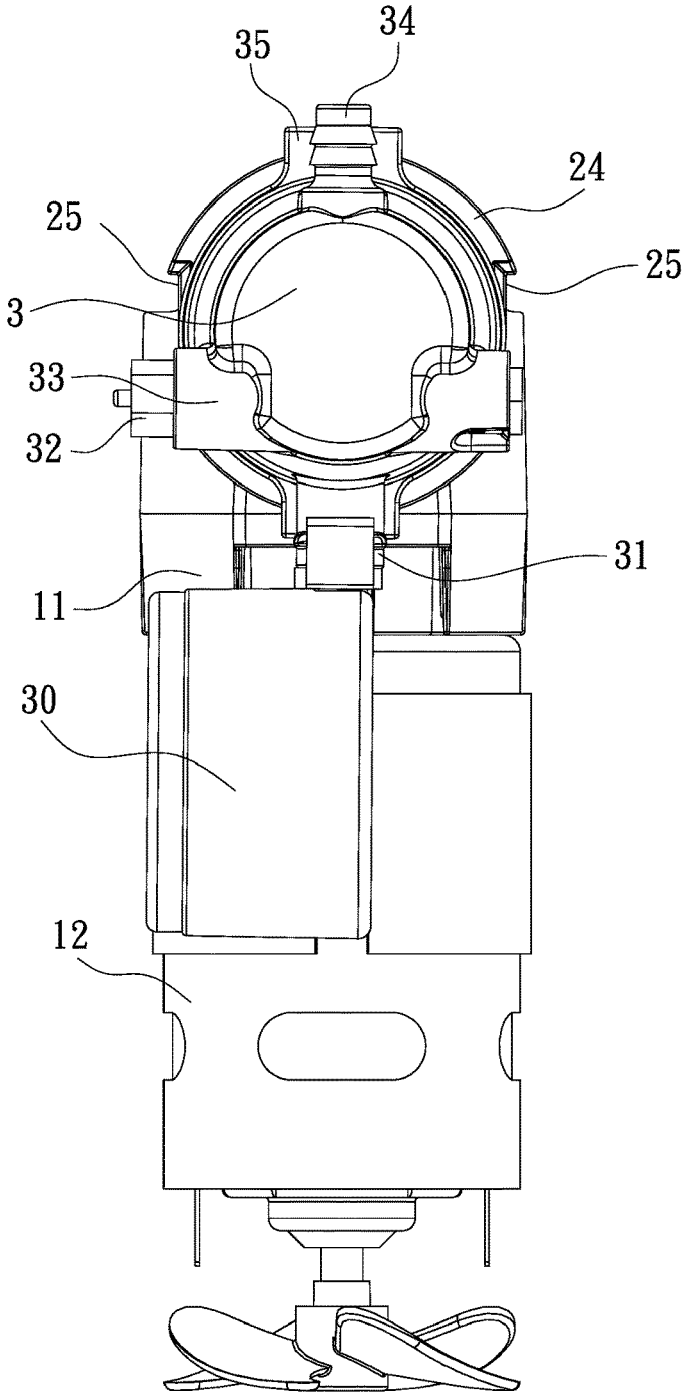
FIG. 7 shows a plan view of the air compressor of the first embodiment, wherein an air storage container is mounted to the cylinder.

Referring to FIG. 1, an air compressor according to a first embodiment of the present invention is shown, which generally comprises a main frame 11, a motor 12 mounted to the main frame 11, a cylinder 2 provided at the main frame 11, and an air storage container 3 capable of communicating with the cylinder 2. The motor 12 can drive a gear 13 to have a piston body 14 conduct reciprocating motion in the cylinder 2 so as to produce therein compressed air which is regulated to enter an inner space 36 of the air storage container 3. The air storage container 3, which is used to store the compressed air produced in the cylinder 2, is provided with one or more outlets. For example, the outlet 31 can be connected with a pressure gauge 30; the outlet 33 can be connected with a relief valve 32; the outlet 34 can be connected with an object to be inflated (not shown).

Figure 10:
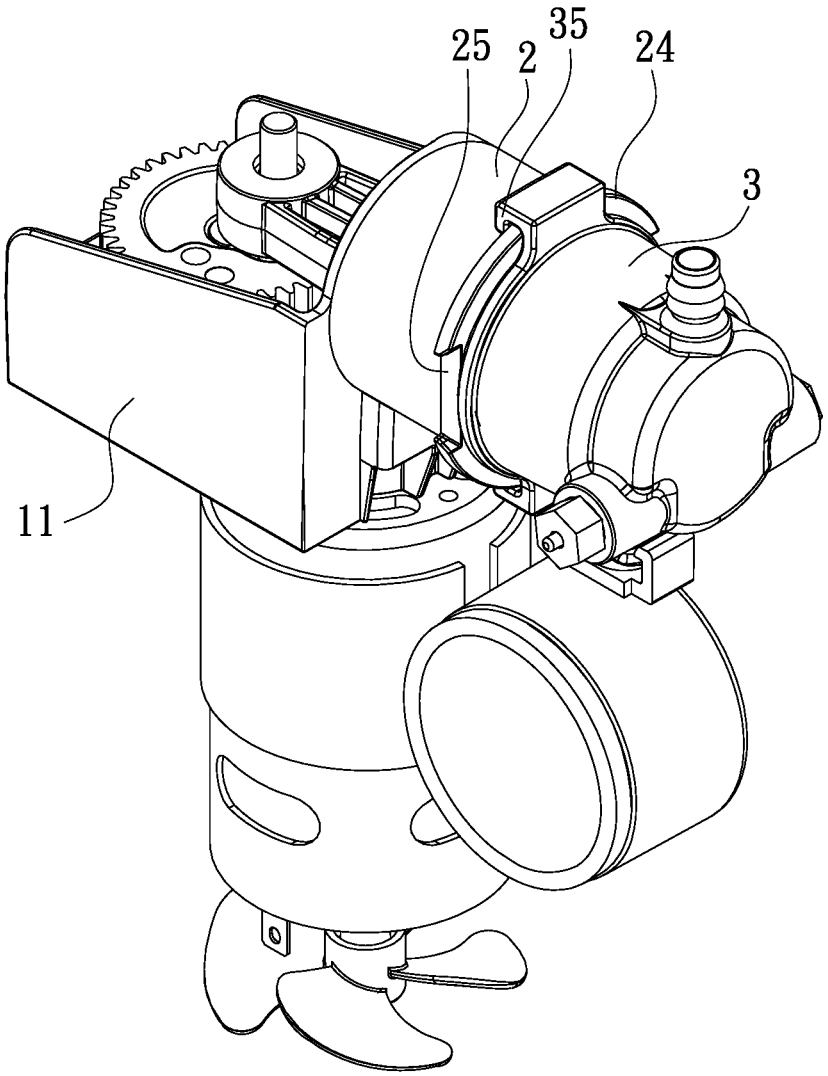
FIG. 10 shows a 3-dimensional view of the air compressor of the first embodiment, wherein two L-shaped holders are engaged with a flange of the cylinder so that the air storage container can be detachably mounted to the cylinder.
Figure 11:
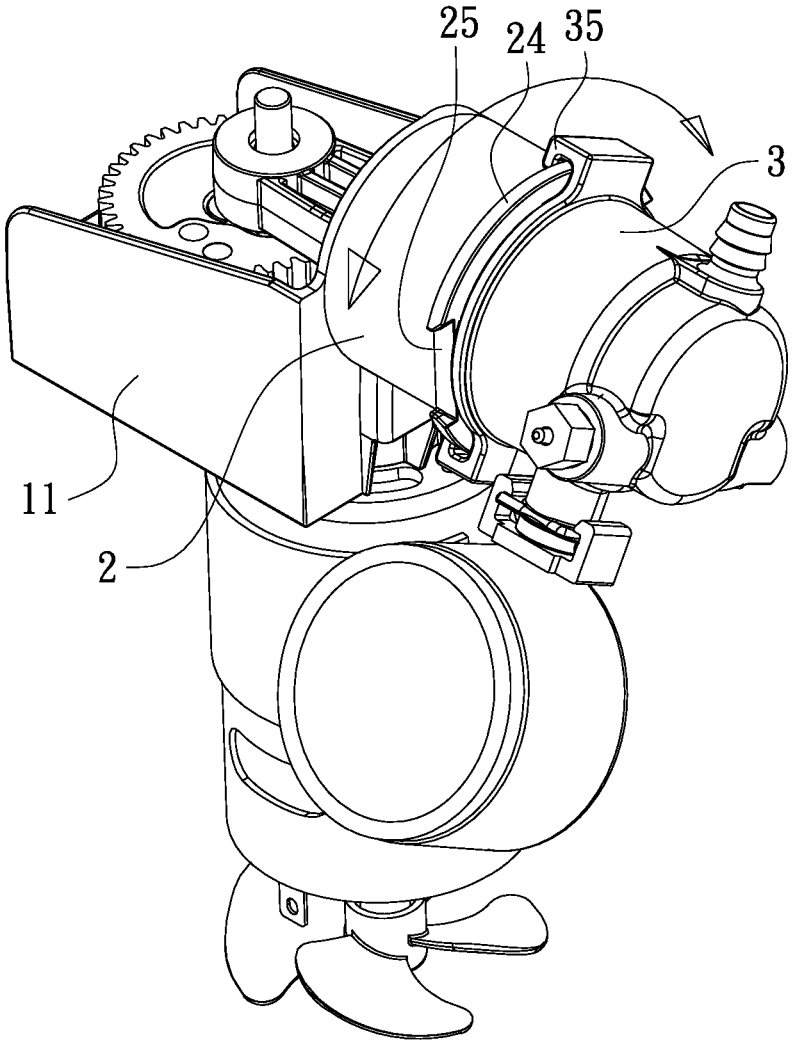
FIG. 11 shows a 3-dimensional view of the air compressor of the first embodiment, wherein the air storage container can be rotated at a range of angle to have it detachably mounted to the cylinder.

As shown in FIGS. 2 through 7, the cylinder 2 of the present invention is different from the cylinders of conventional air compressors, wherein the cylinder 2 defines at its top wall 21 a plurality of exit holes, which allows the compressed air to enter the inner space 36 of the air storage container 3. In this embodiment, there are three exit holes 4, 5, 6, which have different diameters (see FIG. 3). As shown, the exit hole 4 has a diameter of (X); the exit hole 5 has a diameter of (Y); the exit 6 has a diameter of (Z), wherein (X) is greater than (Y), and (Y) is greater than (Z). The cylinder 2 is provided with three valve mechanisms respectively for regulating the three exit holes 4, 5, 6 to open or close. Each valve mechanism includes a plug and a compression spring, wherein the plug has a bottom area that matches a corresponding exit hole; namely, for an exit hole having a larger diameter, its corresponding plug has a larger bottom area. In this embodiment, the plug 7, corresponding to the exit hole 4, has a bottom area (A); the plug 8, corresponding to the exit 5, has a bottom area (B); the plug 9, corresponding to the exit hole 6, has a bottom area (C). Since the exit hole 4 has a diameter greater than the exit hole 5 while the exit hole 5 has a diameter greater than the exit hole 6, the bottom area (A) of the plug 7 will be greater than the bottom area (B) of the plug 8, and the bottom area (B) of the plug 8 is greater than the bottom area (C) of the plug 9 (i.e., A>B>C). The plugs 7, 8, 9 can respectively seal the exit holes 4, 5, 6 (see FIG. 4). The compression springs 71, 81, 91 are respectively disposed on the plugs 7, 8, 9 (see FIG. 5), such that a first end of each compression spring is fitted around the top end of a corresponding plug. A positioning cap 15 has two opposite resilient legs 16 and three columns 152, 153, 154 (see also FIG. 9). The positioning cap 15 is mounted on a tubular projection 22 such that the two opposite resilient legs 16 are engaged with two opposite snap holes 23 defined at the tubular projection 22. Second ends of the compression springs 71, 81, 91 are respectively fitted around the three columns 152, 153, 154 of the positioning cap 15. The three columns 152, 153, 154 are located slightly above the three plugs 7, 8, 9, so as to limit the upward displacement of the plugs 7, 8, 9 when the air compressor is running. As such, the flow rate of the compressed air entering the air storage container 3 can be properly regulated. When the air compressor is not running, the compression springs 71, 81, 91 can respectively urge the plugs 7, 8, 9 to seal the exit holes 4, 5, 6. Furthermore, the cylinder 2 is provided at its top with a flange 24 defining two opposite cuts 25. The air storage container 3 is provided with two opposite L-shaped holders 35, which can be located in the two opposite cuts 25 and rotated at a predetermined angle so as to engage with the flange 25, so that the air storage container 3 can be detachably mounted to the cylinder 2 (see FIG. 10). Referring to FIG. 11, the air storage container 3 can be rotated about the flange 24 at a range of angle, and this feature can facilitate a manufacturer to choose a suitable angle for an air storage container being mounted to a cylinder of an air compressor.

Figure 8:
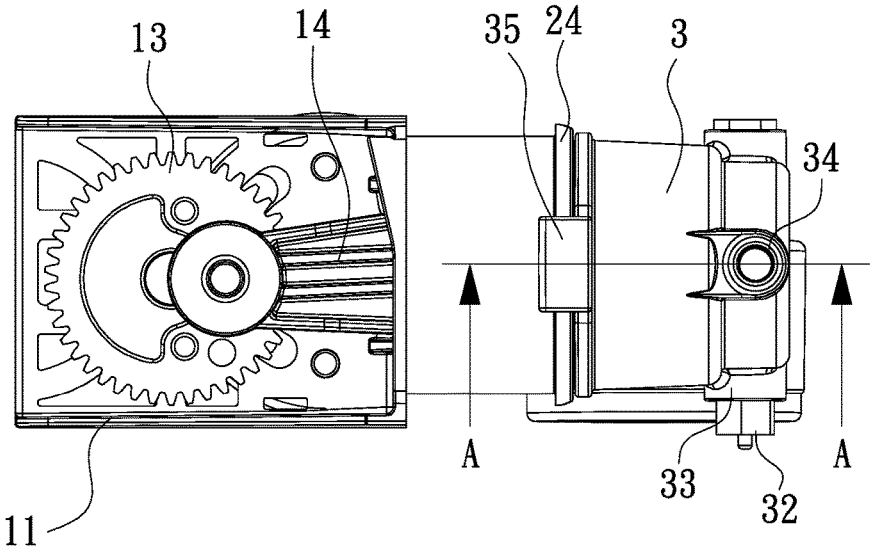
FIG. 8 shows a plan view of the air compressor of the first embodiment, wherein a gear and a piston body used in the air compressor is manifested.
Figure 9:
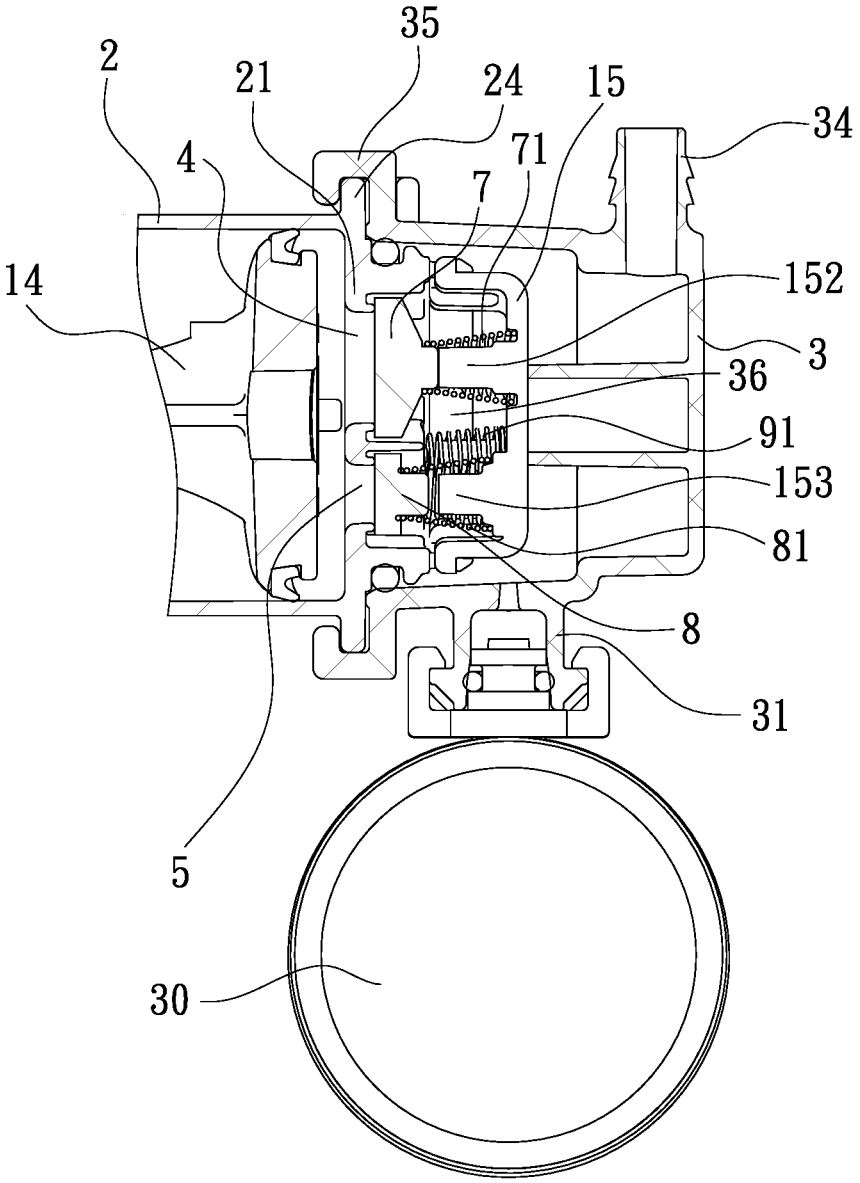
FIG. 9 shows a partially sectional view of the air compressor of the first embodiment taken along line A-A in FIG. 8.

Referring to FIGS. 8 and 9, when the air compressor is started, the piston body 14 can conduct reciprocating motion in the cylinder 2 to produce therein compressed air, which can overcome the compressive force of the compression springs 71, 81, 91 to move the plugs 7, 8, 9 away from their corresponding exit holes 4, 5, 6, so that the compressed air can enter the inner space 36 of the air storage container 3. At an earlier stage of operation, the compressed air can enter the inner space 36 of the air storage container 3 simultaneously via the exits holes 4, 5, 6, so that the flow rate of the compressed air entering the air storage container 3 can be increased significantly. At a later stage of operation, since a large amount of compressed air has been stored in the inner space 36 of the air storage container 3, the stored compressed air can exert back forces on the plugs 7, 8, 9 so that the plugs 7, 8, 9 are further restrained. As a result, the piston body 14 will be subjected to greater resistance while it is conducting reciprocating motion. However, due to the exit holes 4, 5, 6 and the corresponding plugs 7, 8, 9 having different diameters, the plugs 7, 8, 9 are subjected to different back forces. In this embodiment, since the plug 9 has a smallest diameter, it will be subjected to a smallest back force among the plugs; namely, the plug 9 can be pushed away from the exit hole 6 more easily than the other plugs being pushed away their corresponding exit holes. Thus, at a later stage of operation, the motion resistance of the piston body 14 can be reduced, so that the piston body 14 can move in the cylinder 2 more smoothly. Thus, a lower-power motor can be used in the air compressor of the present invention to quickly inflate an object.

To facilitate the displacement of the plugs 7, 8, 9 during the operation of the air compressor, the cylinder 2 can be provided with three groups of spaced ribs 41, 51, 61 on its top wall 21, respectively around the exit holes 4, 5, 6 to confine the corresponding plugs 7, 8, 9 (see FIGS. 2, 3, 4 and 5).

Figure 12:
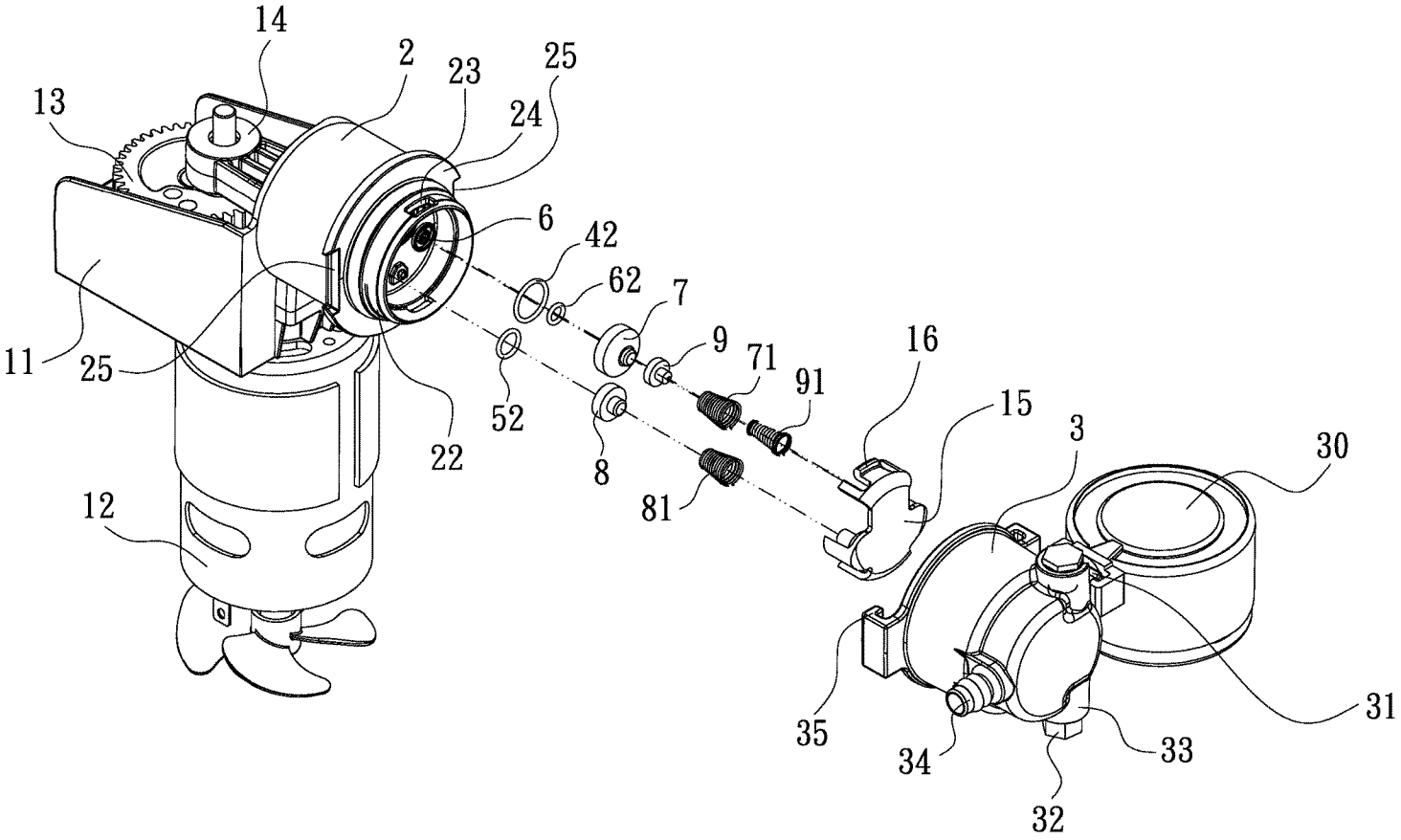
FIG. 12 shows an exploded view of an air compressor according to a second embodiment of the present invention.

FIG. 12 shows a second embodiment of the air compressor, wherein each of the valve mechanisms includes a plug, an O-ring and a compression spring. As shown, the O-rings 42, 52, 62 will be respectively located around the exit holes 4, 5, 6. The plugs 7, 8, 9 will be respectively placed on the O-rings 42, 52, 62. First ends of the compression springs 71, 81, 91 will be fitted around the plugs 7, 8, 9, while second ends of the compression springs 71, 81, 91 will be fitted around the columns 152, 153, 154 of the positioning cap 15. As such, the compression springs 71, 81, 91 can respectively urge their corresponding plugs 7, 8, 9 to press the O-rings 42, 52, 62 against the top wall 21 of the cylinder 2, so that the corresponding exit holes 4, 5, 6 can be sealed properly.

As a summary, the air compressor of the present invention is featured in that the top wall 21 of the cylinder 2 defines a plurality of exit holes having different diameters. The exit holes can be respectively sealed by a plurality of plugs with a plurality of compression springs. In one embodiment, the exit holes 4, 5, 6 can be sealed by the plugs 7, 8, 9 with compression springs 71, 81, 91. As such, the flow rate of the compressed air entering the inner space 36 of the air storage container 3 can be increased significantly. Besides, the plugs 7, 8, 9 are subjected to different back forces, wherein the plug 9 is subjected to a smallest back force as the plug 9 has a smallest area on which the pressure of the compressed air in the air storage tank 3 is applied, so that the plug 9 can be moved away from the exit hole 6 more easily than the other plugs 4, 5, and thus the compressed air can enter the inner space 36 of the air storage container 3 more easily via the exit hole 6 at a later stage of operation. Consequently, the motion resistance of the piston body 14 can be reduced. Thus, a lower-power motor can be used in the air compressor to quickly inflate an object. This feature renders the present invention useful and inventive.

I claim:

1. In an air compressor including a main frame, a motor mounted to the main frame, a cylinder provided at the main frame, and an air storage container capable of communicating with the cylinder, the motor capable of rotating a gear to have a piston body conduct reciprocating motion in the cylinder so as to produce therein compressed air which is regulated to enter an inner space of the air storage container, wherein the improvement comprises:

the cylinder defines at its top wall a plurality of exit holes and is provided with a plurality of valve mechanisms, each valve mechanism including a plug and a compression spring, the plug having a bottom area that matches a corresponding exit hole, the compression spring urging the plug to seal the corresponding exit hole, whereby the compressed air is regulated by the valve mechanisms to enter the inner space of the air storage container; and wherein the cylinder is provided on its top wall with a tubular projection which defines two opposite snap holes; a positioning cap has two opposite resilient legs engaged with the snap holes and has a plurality of columns each being located slightly above a corresponding plug to limit the displacement of the corresponding plug for controlling the flow rate of the compressed air entering the air storage container; one end of each compression spring is fitted around a top of a corresponding plug while another end of each compression spring is fitted around a corresponding column.

2. The air compressor of claim 1, wherein the exit holes are configured to have different diameters such that the corresponding plugs are subjected to different back forces exerted by the compressed air that has entered the inner space of the air storage container.

3. The air compressor of claim 1, wherein each valve mechanism further includes an O-ring being located on the top wall of the cylinder, around a corresponding exit hole, and under a corresponding plug, such that a corresponding compression spring urges the corresponding plug to press the O-ring against the top wall of the cylinder so as to seal the corresponding exit hole.

4. In an air compressor including a main frame, a motor mounted to the main frame, a cylinder provided at the main frame, and an air storage container capable of communicating with the cylinder, the motor capable of rotating a gear to have a piston body conduct reciprocating motion in the cylinder so as to produce therein compressed air which is regulated to enter an inner space of the air storage container, wherein the improvement comprises:

the cylinder defines at its top wall a plurality of exit holes and is provided with a plurality of valve mechanisms, each valve mechanism including a plug and a compression spring, the plug having a bottom area that matches a corresponding exit hole, the compression spring urging the plug to seal the corresponding exit hole, whereby the compressed air is regulated by the valve mechanisms to enter the inner space of the air storage container; and wherein the cylinder is provided with plural groups of spaced ribs on its top wall, each group of spaced ribs being configured to substantially surround a corresponding exit hole so as to confine a corresponding plug.

5. The air compressor of claim 4, wherein the exit holes are configured to have different diameters such that the corresponding plugs are subjected to different back forces exerted by the compressed air that has entered the inner space of the air storage container.

6. The air compressor of claim 4, wherein each valve mechanism further includes an O-ring being located on the top wall of the cylinder, around a corresponding exit hole, and under a corresponding plug, such that a corresponding compression spring urges the corresponding plug to press the O-ring against the top wall of the cylinder so as to seal the corresponding exit hole.

7. In an air compressor including a main frame, a motor mounted to the main frame, a cylinder provided at the main frame, and an air storage container capable of communicating with the cylinder, the motor capable of rotating a gear to have a piston body conduct reciprocating motion in the cylinder so as to produce therein compressed air which is regulated to enter an inner space of the air storage container, wherein the improvement comprises:

the cylinder defines at its top wall a plurality of exit holes and is provided with a plurality of valve mechanisms, each valve mechanism including a plug and a compression spring, the plug having a bottom area that matches a corresponding exit hole, the compression spring urging the plug to seal the corresponding exit hole, whereby the compressed air is regulated by the valve mechanisms to enter the inner space of the air storage container; and wherein the cylinder is provided at its top with a flange defining two opposite cuts; the air storage container is provided with two opposite L-shaped holders capable of being respectively located at the two cuts of the flange and being rotated at a predetermined angle so as to engage with the flange, so that the air storage container can be detachably mounted to the cylinder.

8. The air compressor of claim 7, wherein the exit holes are configured to have different diameters such that the corresponding plugs are subjected to different back forces exerted by the compressed air that has entered the inner space of the air storage container.

9. The air compressor of claim 7, wherein each valve mechanism further includes an O-ring being located on the top wall of the cylinder, around a corresponding exit hole, and under a corresponding plug, such that a corresponding compression spring urges the corresponding plug to press the O-ring against the top wall of the cylinder so as to seal the corresponding exit hole.

* * * * *